US005103902A

United States Patent [19]

Ross et al.

[11] Patent Number: 5,103,902

[45] Date of Patent: Apr. 14, 1992

[54] NON-ROTATIONAL VERSA-TRIEVE PACKER

[75] Inventors: Colby M. Ross; Ralph H. Echols, III, both of Carrollton, Tex.

[73] Assignee: Otis Engineering Corporation, Carrollton, Tex.

[21] Appl. No.: 651,728

[22] Filed: Feb. 7, 1991

[51] Int. Cl.[5] ..... E21B 23/06; E21B 33/128; E21B 33/129

[52] U.S. Cl. ..... 166/120; 166/51; 166/123; 166/240

[58] Field of Search ..... 166/120, 123, 134, 138, 166/51, 240

[56] References Cited

U.S. PATENT DOCUMENTS

| | | | |
|---|---|---|---|
| 3,024,845 | 3/1962 | Conrad | 166/240 X |
| 4,018,272 | 4/1977 | Brown et al. | 166/119 |
| 4,135,577 | 1/1979 | Nelson et al. | 166/240 X |
| 4,180,132 | 12/1979 | Young | 166/120 |
| 4,403,654 | 9/1983 | Haynes | 166/240 X |
| 4,438,811 | 3/1984 | Patel | 166/123 |
| 4,516,634 | 5/1985 | Pitts | 166/120 |
| 4,611,658 | 9/1986 | Salerni et al. | 166/138 X |
| 4,664,188 | 5/1987 | Zunkel et al. | 166/134 |
| 4,671,354 | 6/1987 | Henderson et al. | 166/134 |
| 4,793,411 | 12/1988 | Zunkel | 166/51 X |
| 4,834,175 | 5/1989 | Ross et al. | 166/120 |
| 4,842,057 | 6/1989 | Lubitz | 166/51 |

*Primary Examiner*—Stephen J. Novosad
*Attorney, Agent, or Firm*—Dennis T. Griggs

[57] ABSTRACT

A retrievable packer includes a selectively releasable anti-rotation coupling lug for preventing premature setting of the packer. The lower wedge and packer mandrel are coupled together by the anti-rotation lug during running and setting operations. The anti-rotation lug is slidably received within an L-slot formed in the packer mandrel, and is selectively releasable to permit rotation of the service tool relative to the packer mandrel during retrieving operations. During run-in and retrieving operations, the anti-rotation lug is confined within a circumferentially extending portion of the L-slot, thereby limiting longitudinal travel of the packer mandrel relative to the lower wedge. The service tool can then set down on the packer for pushing the lower wedge out from under the anchor slip. The anti-rotation lug also provides a rotational lock between the slip carrier and the lower wedge, thereby preventing rotation of the slip carrier and anchor slips relative to the lower packer components during running and setting operations.

17 Claims, 5 Drawing Sheets

NON-ROTATIONAL VERSA-TRIEVE PACKER

FIELD OF THE INVENTION

This invention relates to tools and equipment for completing downhole wells, and in particular to retrievable well packers for securely sealing the annulus between a tubing string and the bore of a surrounding well casing.

BACKGROUND OF THE INVENTION

In the course of treating and preparing subterranean wells for production, a well packer and screen along with a service tool are run into the well on a work string, with the packer being releasably anchored against a casing bore.

It is necessary to manipulate the service tool within the well to set, position or release the packer. The success of such operations is dependent upon the ability to reciprocate the tool vertically and/or rotate it relative to the packer. Rotational displacement of the tool in some wells, for example in deviated wells, is difficult to perform reliably because of frictional binding between the work string and the well casing.

During run-in, the packer is mechanically locked in the unset condition by shear pins to prevent premature setting. It is essential that the packer remain in the unset condition while withstanding run-in forces caused by jarring, torquing and compression/tension loading as the packer is forced through tight bends, for example in deviated bores and in horizontal completions. Moreover, it is desirable that the packer be retrievable from the well by appropriate manipulation of the tubing string and tool to cause the packer to be released and unsealed from the well bore. In some installations, the packer may be released from set engagement by a straight pull upwardly on the work string, or by rotation of the work string, or by a combination of straight pull and rotation operations.

DESCRIPTION OF THE PRIOR ART

In the construction of a certain class of packers which are run, set and released with the aid of a setting tool suspended from a work string, the packer includes a J-slot and the setting tool includes a coupling collar having a pin which is engagable within the J-slot. In some installations, the J-slot may become obstructed by debris or sand, which will prevent rotation of the tool mandrel out of the J-slot. One modification to overcome this problem is the installation of shear pins onto a stop ring, thereby coupling the stop ring and mandrel together. This helps prevent rotation of the top sub while trying to release the lugs at the top of the packer from the J-slot.

The foregoing modification proved suitable until it was determined that on occasions where the setting tool did not release properly from the J-slot, tools in the packer became stuck. It was also determined that the shear pins which were installed in the stop ring would become separated, which eliminated the anti-rotation feature. In that situation, it became necessary to shear the lugs at the top of the packer in order to retrieve the tool to the surface, since there was no practical way of holding the packer mandrel steady while pulling away from it.

OBJECTS OF THE INVENTION

Accordingly, the general object of the present invention is to provide an improved packer having a selectively releasable anti-rotation coupling for the transmission of torque through the packer assembly in all operating modes A related object of this invention is to provide anti-rotation structure for coupling the packer mandrel and lower wedge together during running and setting operations, and which can permit rotation of a service tool relative to the packer during milling or retrieving operations.

Another object of this invention is to provide an improved well packer having an anti-rotation coupling for rotatably locking the packer mandrel and lower wedge together during running and setting operations, and which can be selectively released to permit relative rotation and application of set down jarring loads against the packer mandrel to produce separation of the lower wedge away from the anchor slip during a retrieving operation.

SUMMARY OF THE INVENTION

The foregoing objects are achieved according to a preferred embodiment of the present invention in which a packer has a hydraulic piston assembly coupled in driving engagement against annular packing seal elements and anchor slips. The annular packing seal elements, hydraulic piston and anchor slips are mounted for sliding movement along the packer mandrel. Setting forces are applied to the annular seal elements and the anchor slips by the annular piston which is sealed against the packer mandrel and against the bore of the setting cylinder.

The setting force applied by the piston is transmitted to the anchor slips through an upper tubular wedge which is initially locked to the piston by a shear screw. Additionally, the setting cylinder is mechanically restrained from extension by the blocking engagement of a transfer support lug supported on the tubular wedge. According to this arrangement, the shear screw is decoupled with respect to mechanical impact forces transmitted through the packer mandrel, and the setting cylinder and the upper tubular wedge are locked against relative movement to prevent premature setting of the packer during run-in.

According to an important feature of the invention, an anti-rotation lug couples the lower wedge and packer mandrel together during running and setting operations. The lower wedge is movably coupled to the packer mandrel by the anti-rotation lug which is slidably received within an L-slot formed in the packer mandrel. The anti-rotation lug is selectively releasable to permit rotation of the service tool relative to the packer mandrel during retrieving operations. The anti-rotation lug also permits the service tool mandrel to be rotated relative to the packer and then set down on the packer for pushing the lower wedge out from under the anchor slip. This arrangement is important, for example, where the anchor slips are heavily embedded in the casing wall, and upward movement of the packer to release the anchor slips is not possible because the slips and lower wedge may be under compression loading.

During run-in and set operations, the anti-rotation lug remains in the uppermost longitudinal portion of the L-slot since there is no relative motion between the lower wedge and the packer mandrel. The L-slot in the packer mandrel includes a circumferentially extending slot portion which permits the anti-rotation lug to be rotated out of the longitudinal slot portion and into the circumferentially extending slot portion in response to right hand rotation of the tubing string. After the anti-rotation lug ha been moved out of the longitudinal slot and into the circumferential slot, weight can be set down on the packer mandrel, and pull up and set down jarring forces can be applied to assist in retrieving a stuck packer. Additionally, heavy set down forces can be applied to the packer mandrel to cause the lower wedge to physically retract out of engagement with the anchor slip, thereby permitting the anchor slips to retract away from the set position.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1:
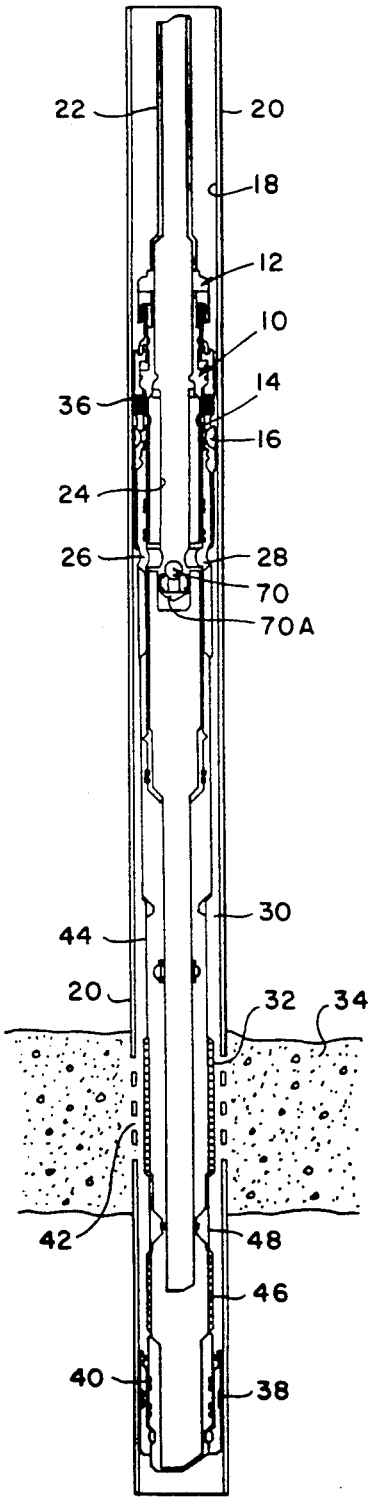
FIG. 1 is a simplified view, partly in section and partly in elevation, showing a typical gravel pack well installation in which the non-rotational packer of the present invention is incorporated.

In the description which follows, like parts are marked throughout the specification and drawings with the same reference numerals, respectively.

Referring now to FIGURE operation of the non-rotational packer 10 of the present invention will be explained with reference to a typical gravel pack service operation in which a service tool 12 is landed within the bore 14 of the packer. The packer 10 has mechanically actuated anchor slips 16 which set the packer against the inside bore 18 of a tubular well casing 20. The service tool 12 is sealed against the bore of the packer for delivering a gravel slurry pumped through the work string 22 and bore 24 of the service tool through lateral flow passages 26 which intersect the sidewall of the tool 10, and which communicate with lateral flow passages 28 which intersect the sidewall of the packer 10. The annulus 30 between the casing 20 and sand screen 32 is sealed above and below a producing formation 34 by expanded annular seal elements 36 carried on upper packer 14 and expanded annular seal elements 38 carried on a sump packer 40. During the gravel pack operation, the work string 22 is filled with slurry which is pumped into annulus 30 and perforations 42 to fill either or both spaces and/or the surrounding formation 34.

Figure 2:
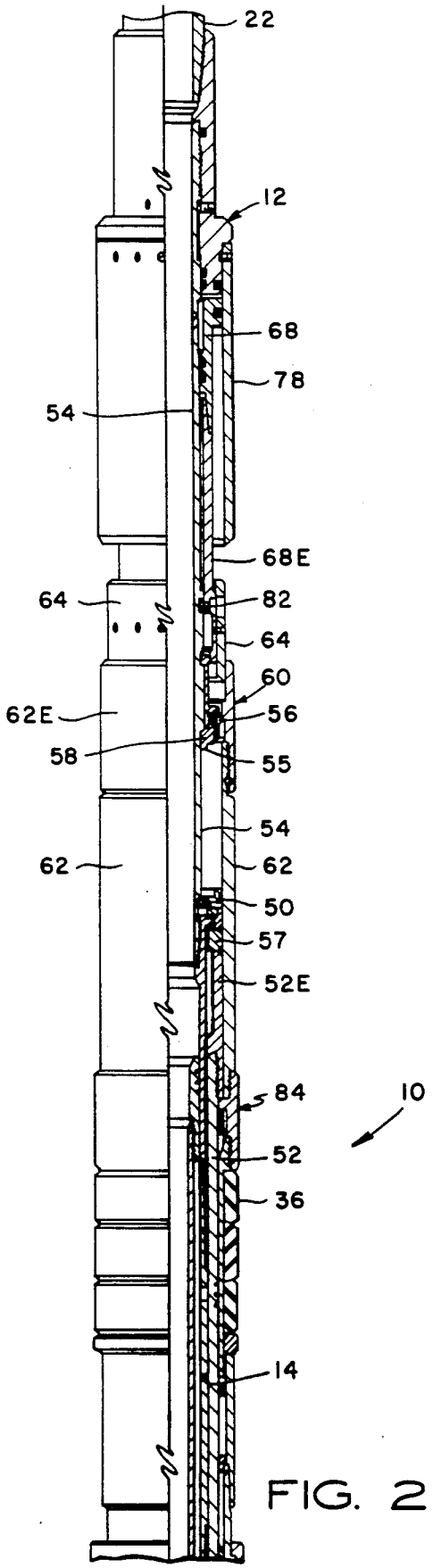
FIG. 2 is a view, partly in elevation and partly in section, which illustrates the position of a multi-position tool relative to the packer of FIG. 1 during a run-in operation.
Figure 3:
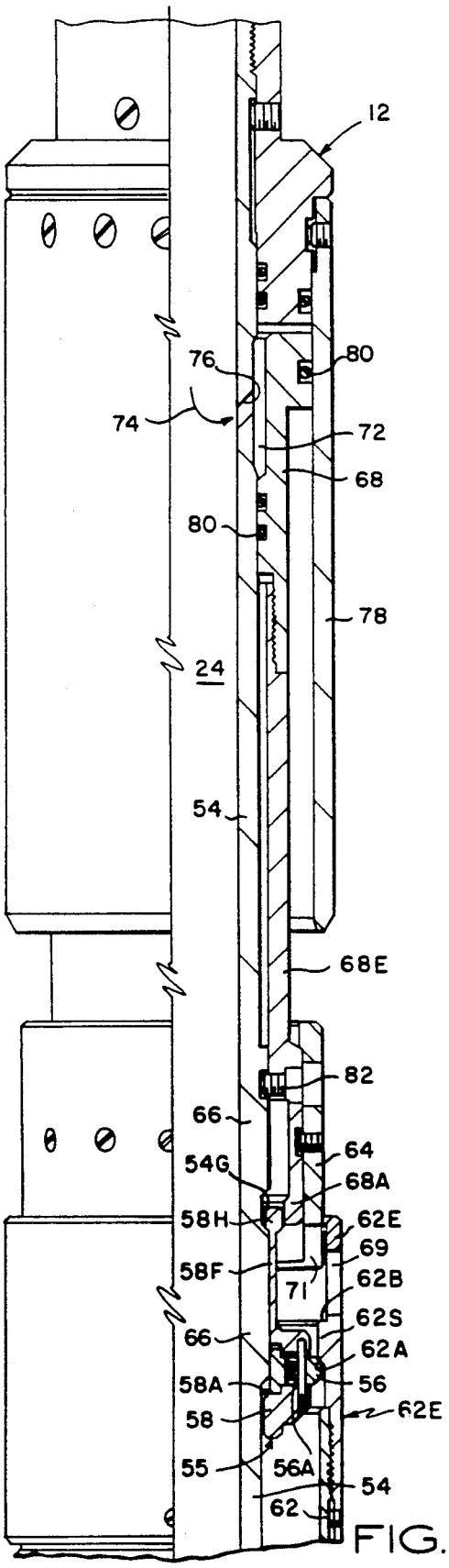
FIG. 3 is a view, partly in section and partly in elevation, showing details of an annular piston and support lug assembly.
Figure 4:
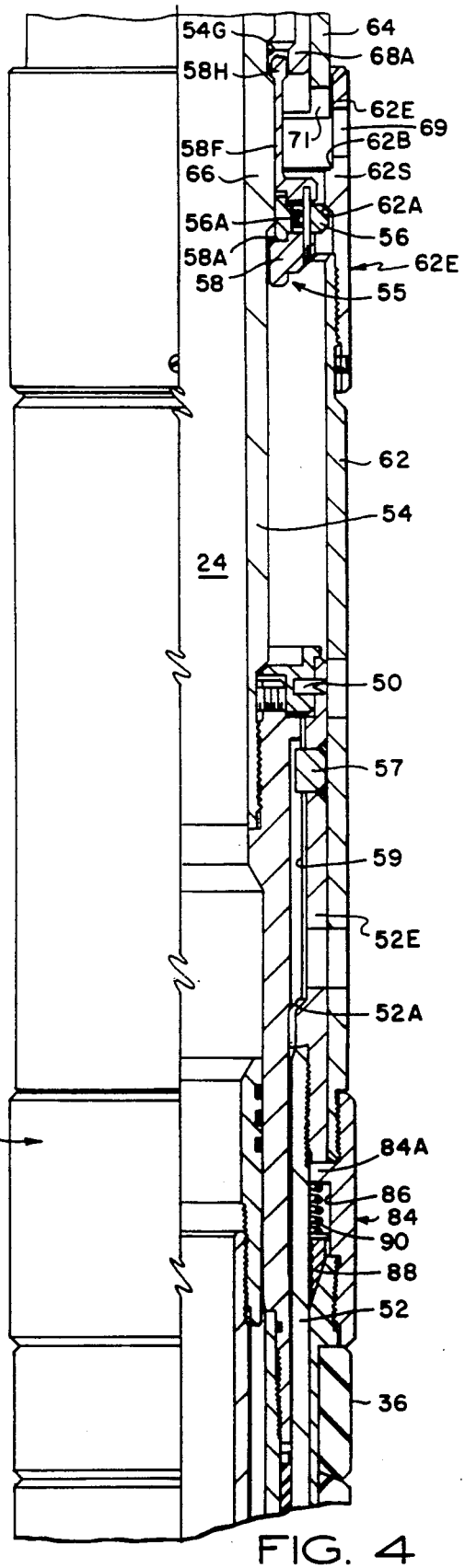
FIG. 4 is a continuation of FIG. 3 which illustrates the relative position of transit lugs with respect to separation shear pins during a run-in operation.

Referring now to FIGS. 2, 3 and 4, the service tool 12 is rigidly locked onto the packer 10 during the initial run-in operation. According to this arrangement, the packer 10, service tool 12 and all the equipment which is hung off of the packer are run in through the bore 18 of the casing 20 as an assembled unit. In this instance, the sand screen 32 is hung off of the packer 14 by a length of blank pipe 44 and a tell-tale screen 46 is connected to the sand screen by a polished nipple 48. It will be appreciated that the hang weight of the packer, along with the downhole equipment attached to it, is substantial.

A group of separation shear pins 50 maintain the packer in the unset condition and are decoupled with respect to run-in handling forces by a transfer support assembly 55 which include a group of transit support lugs 56 which are carried by a collet 58 which is movably mounted onto the service tool mandrel 54. The transit lugs 56 carry the weight of the packer and the weight of equipment hanging from the packer so that no weight is applied to the separation shear pins 50 during the run-in procedure.

The transit support lugs 56 are fully retracted radially inwardly by spring 56A, thereby permitting the service tool 10 to be reciprocated freely within the packer bore 14. A pin 57 projects into the bore of the packer mandrel extension 52E, with its inner end received within a locator slot 59. This arrangement permits torque to be transmitted from the service tool to the packer mandrel, if necessary, to aid in a running operation.

Referring to FIG. 3 and FIG. 4, the transit support lugs 56 are engaged against an annular shoulder 62A which is formed on a tube guide extension 62E. Each transit support lug 56 engages the underside 62A of the annular shoulder 62S, with the upper surface 62B of the shoulder being aligned for engagement with a setting sleeve 64. The hang weight of the packer 14 is transmitted through the tube guide 62 and through the transit lugs 56 and collet 58 to the service tool mandrel 54. That is, the packer and equipment attached to it are supported by the work string 22 through the service tool mandrel 54, the transit support lugs 56 and the packer tube guide 62, with the result that handling forces which arise during the run-in operation are decoupled with respect to the separation pins 50.

The service tool 12 is provided with a locking flange 66 which is engaged by a shoulder portion 58A of the collet 58 to limit its upward movement thereto. The collet is held in the position shown in FIGS. 3 and 4 by its finger portions 58F having their head portions 58H received in a detent groove 54G formed in the service tool mandrel 54 above the shoulder of the locking flange 66. The head portion 58H is engaged and prevented from deflecting by a piston shoulder 68A which forms a part of an annular piston 68 mounted for sliding movement along the service tool mandrel 54.

The collet 58 carries the running lugs 56 which support the hang weight of the packer 10. When improperly supported, the hang weight load is transferred to the setting pins in the top of the packer. Improper support also allows the setting sleeve to move with the potential of presetting while running. The jarring action of running down hole will also weaken the setting pins, thereby increasing the risk of premature set. To prevent such problems, the collet 58 should be properly located relative to the piston extension 68A. Both parts should be pushed into position with the packer guide in place until the lugs expand and trap the tube guide 62. The piston extension 68A should be pushed up only far enough to align the shear pin holes. Driving the piston extension too far upward could allow the collet fingers to spring outward. Attempts to push the piston extension downwardly may only drive the collet out of its screw. An inspection port 69 is formed through the sidewall of the tube guide extension 62E to permit visual inspection of the collet fingers 58F and collet head portions 58H (FIG. 3). An inspection port 71 is formed through the end portion of the setting sleeve 64 to permit a visual inspection and confirmation that the collet head portions 58H are supported by the piston extension shoulder 68A.

The transit support lugs 56 are released and the packer 10 is set by dropping a ball plug 70 through the work string 22 and into the bore 24 of the service tool. Pressurized fluid pumped down the work string 22 enters an annulus 72 formed between the piston 68 and the service tool mandrel 54. The pressurized fluid as indicated by the arrow 74 enters the annulus 72 through an inlet flow port 76 formed in the tool mandrel 54.

The piston 68 is guided for movement along the external surface of the service tool mandrel 54 by a guide cylinder 78. The piston annulus 72 is sealed along the inside bore of the guide cylinder 78 and along the external surface of the tool mandrel 54 by O-ring seals 80. Movement of the piston 68 is initially opposed by a group of transit shear pins 82. As shown in FIGURE 3, the piston 62 has an extension sleeve 68E which is attached to the tool mandrel locking ring 66 by the transit shear pins 82.

The piston 68 is mounted for slidable movement along the packer mandrel external surface 118 and is also disposed in slidable, sealing engagement against the internal cylindrical bore of the piston guide cylinder 78. The annulus 78A between the piston internal bore and the external mandrel surface 11 defines a variable volume pressure chamber 72 for directing hydraulic pressure against the piston head.

The packer 10 is set by increasing the hydraulic pressure to a level great enough to cause the transit shear pins 82 to shear, thereby releasing the piston 68 and permitting it to drive the setting sleeve 64 downwardly against the shoulder 62S of the tube guide extension 62E. The collet 58 remains in place as the piston is driven downwardly. The piston shoulder 68A clears the collet head 58H, thereby permitting it to deflect and also permitting the collet transfer assembly 55 to move downwardly along the locking ring 66, and permitting the spring loaded support lugs 56 to retract radially inwardly. When this occurs, the hang weight of the packer is transferred from the support lugs 56 to the separation pins 50.

Figures 5, 5A:
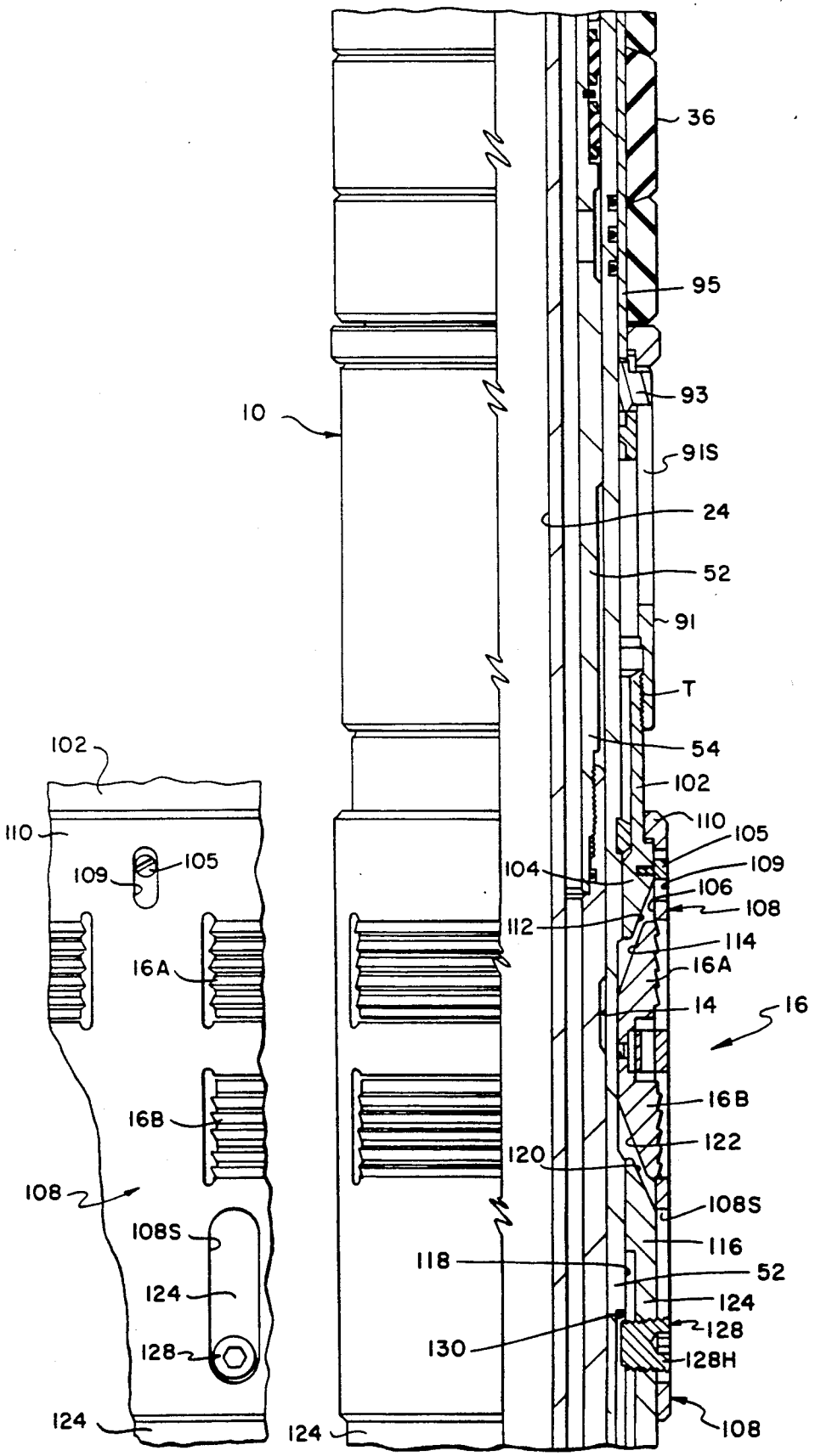
FIG. 5 illustrates the position of the packer tube guide as driven by the annular piston for engaging packer slips.
FIG. 5A is an elevational view, partially broken away, of the slip carrier assembly shown in FIG. 5.

Referring now to FIGS. 4 and 5, the tube guide 62 is movable relative to the packer mandrel 52. The seal element 36 and slips 16 are coupled to the tube guide 62 by a connecting sub 84. Confined within an annulus 86 formed between the connecting sub 84 and the packer mandrel 52 is an internal locking slip ring 88. The slip ring assembly 88 is biased by a coil spring 90 which is combined between the slip ring 88 and an annular shoulder portion 84A of the connecting sub. The annular slip ring 88 functions as an internal slip which prevents reverse movement of the tube guide 62 and connecting sub 84 relative to the packer mandrel 52. Accordingly, the tube guide 62 is moved downwardly relative to the packer mandrel 52 in response to continued extension of the piston 68. The setting force is transmitted through the tube guide 62 and connecting sub 84 against the seal elements 36.

The seal elements 36 are slidably mounted onto the external surface of the packer mandrel 52, and are displaced longitudinally and expanded radially as the setting force is applied. The seal elements 36 are confined axially between the connecting sub 84 and a setting cylinder 91 The setting cylinder 91 has a longitudinal slot 91S in which a guide pin 93 is received. The seal elements 36 are carried by a mandrel 95 which is mounted onto the packer mandrel 52 for sliding movement. The guide pin 93 is mechanically secured onto the seal element mandrel 95. The guide pin 93 stabilizes movement of the setting cylinder 91 relative to the tube guide 62, connecting sub 84 and seal element mandrel 95 as the piston 68 is extended. Additionally, the guide pin 93 rotationally locks the setting cylinder to the outer packer components to accommodate a milling operation, if required.

The setting force is transmitted to the anchor slip assembly 16 by an upper wedge assembly 102 as discussed below. The setting cylinder 91 is mechanically coupled to the upper wedge 102 by a threaded union T. As the piston 68 nears the limit of its extension along the service tool mandrel 54, the seal elements 36 are expanded and anchor the slips 16 are engaged and set against the inside bore 18 of the well casing 20.

Because the packer mandrel 52 is anchored onto the tool mandrel 54 by the separation shear pins 50, the packer tube guide 62 continues its downward movement relative to the packer mandrel. Once the desired slip setting pressure has been achieved and the packer 14 is securely anchored in place, the setting tool 12 can then be released from the packer 10 by increasing the hydraulic pressure and/or by pulling the work string 22 upwardly to cause shearing of the separation shear pins 50.

The lower end of the packer mandrel 52 is connected to a tubular bottom sub 92 by a release coupling assembly 94 which includes a stop ring 96, a shifting sleeve 98 and a shear sleeve 100 which are interconnected to permit release and retrieval of the packer from the well bore, as discussed in further detail hereinafter. The tubing string 22, which may be a well production string, for example, is attached by a threaded union onto the bottom sub 92 and continued below the packer within the well casing 20 by means of additional tubing elements extended downwardly through the casing bore for supporting the sand screen 32, polished nipple 48, tell-tail screen 46 and sump packer 40. The central passage of the packer bore 14 as well as the polished nipple bore and bottom sub bore are concentric with and form a continuation of the tubular bore of the tubing string 22.

Referring now to FIG. 5 and FIG. 5A, the annular piston 68 is movably coupled to the anchor slip assembly 16 by a tubular top wedge 102 which extends between the external surface of the packer mandrel and the internal bore of the slip carrier 108. The top wedge 102 includes a spreader cone 104 which extends downwardly within the bore 106 of the slip carrier 108 and fits under an inwardly directing flange 110 of the slip carrier. The spreader cone 104 and slip carrier flange 110 have mating shoulders which define the limit of axial movement of the spreader cone 104 upwardly relative to the slip carrier 108. Axial movement of the spreader cone 104 is stabilized by a cap screw 105. The cap screw 105 is slidably received within a longitudinal slot 109 which intersects the slip carrier housing 108. The shank of the cap screw 105 is fastened in a threaded bore in the top spreader cone 104 and projects radially into the slot 109, thereby preventing rotation of the spreader cone and upper wedge relative to the slip carrier 108. The spreader cone 104 has an inwardly sloping, frustoconical wedging surface 112 which is generally complementary to the outwardly sloping, slanted upper cam surface 114 of the upper anchor slip portion 16A.

A lower spreader cone 116 is positioned between the external surface 118 of the packer mandrel and the lower internal bore of the slip carrier 108. The spreader cone 116 presents an upwardly facing frustoconical wedging surface 120 generally complementary to the downwardly facing cam surface 122 on the lower anchor slip portion 16B. The lower cone 116 is connected to a tubular bottom wedge 124 which is received within an annular pocket defined between the annular stop ring 96 and the external packer mandrel surface 118. Longitudinal travel of the tubular bottom wedge 124 is limited by the stop ring 96, which reacts compression forces transmitted through the anchor slip upon being engaged by the upper spreader cone.

Figure 6A:
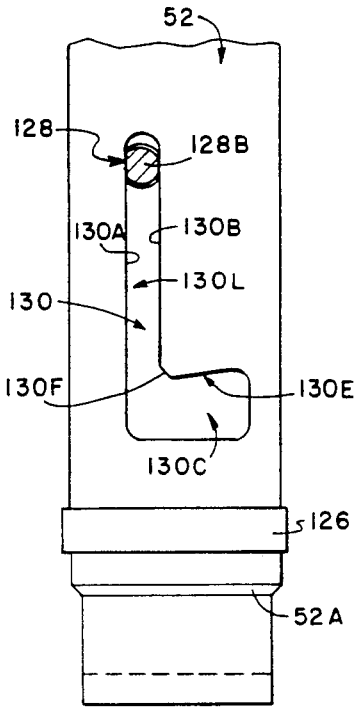
FIG. 6A is an elevational view, partially broken away, of the lower end of the packer mandrel of FIG. 6, in which an L-slot is formed.
Figure 6B:
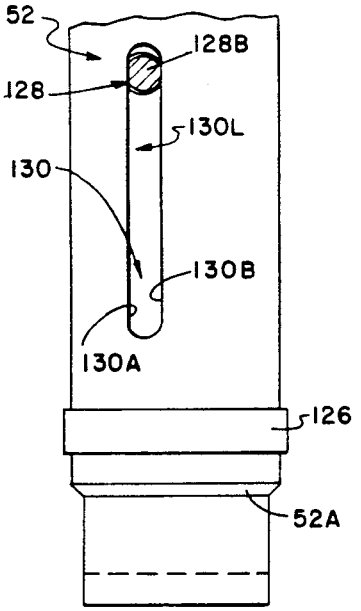
FIG. 6B is a view similar to FIG. 6A showing the lower end of the packer mandrel of FIG. 6, in which a straight longitudinal slot is formed.
Figure 6:
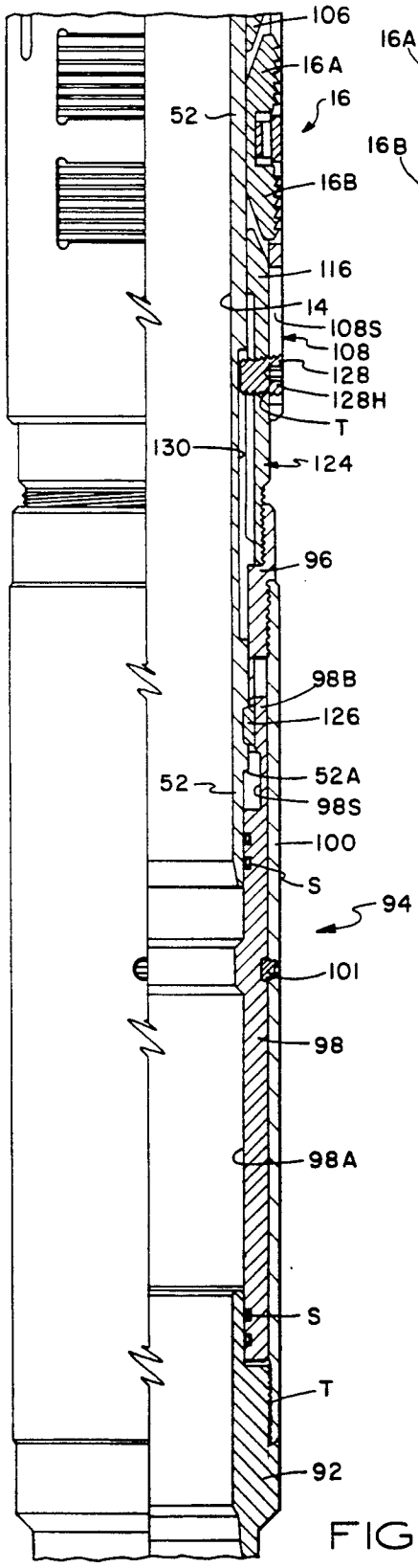
FIG. 6 is a continuation of FIG. 5 which illustrates the lower end of the packer coupled to a bottom sub.
Figure 6C:
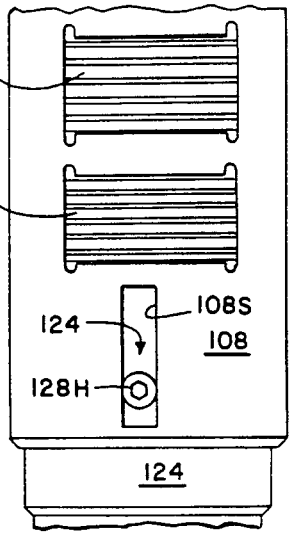
FIG. 6C is an elevational view, partially broken away, of the anchor slip carrier cage assembly shown in FIG. 6.
Figure 7:
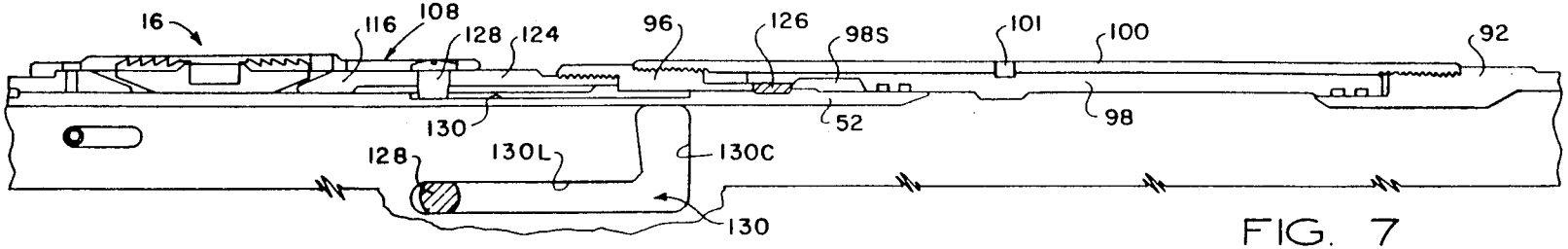
FIG. 7 is a simplified view of the packer of FIG. 6, with the anti-rotation lug being shown in the run position.
Figure 8:
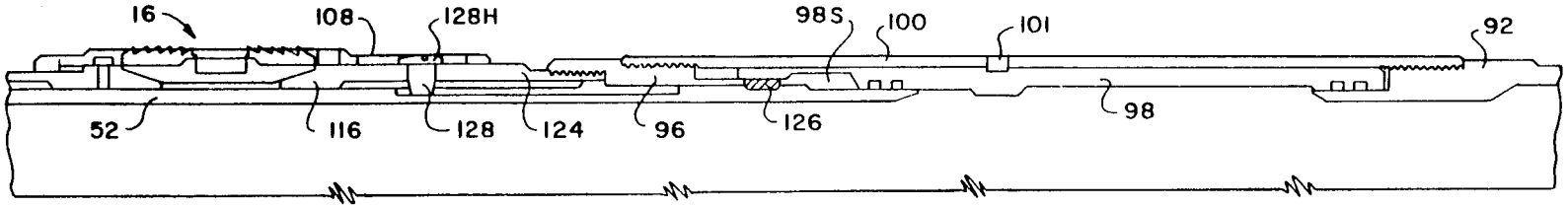
FIG. 8 is a view similar to FIG. 7 with the anti-rotation lug and packer components being shown in the set position.

In the run-in position as illustrated in FIGS. 5, 6 and 7, the tubular bottom wedge 124 is fully retracted within the annular pocket, and consequently, as the top wedge 102 is driven into engagement with the anchor slip 16A, the anchor slip 16 is displaced radially outwardly as the spreader cones 16A, 16B engage and slip along the sloping cam surfaces 114, 122 respectively. The lower wedge 124 is blocked against further downward movement relative to the slip carrier 108 by the stop ring 96.

Continued movement of the piston 68 downwardly brings the setting sleeve 64 of the service tool 12 to bear against the guide tube 62 of the packer, thereby moving the outer components of the packer relative to the packer mandrel, and in doing so, expanding the seals 36 and setting the anchor slips 16. After the packer slips have been securely set and the annular seal elements 36 have been expanded, the separation pins 50 are sheared by an increase in hydraulic pressure and/or a simple upward pulling force applied to the work string 22. Movement of the service tool is then possible by straight up or down movement of the work string at the surface.

Referring again to FIG. 6, the lower end of the packer mandrel 52 is sealed against the internal bore 98A of the shifting sleeve 98 by O-ring seals S. The shifting sleeve 98 is likewise sealed against the bottom sub 92 by O-ring seals S. The shifting sleeve 98 has an annular shifting slot 98S for receiving a snap ring 126 during a retrieving operation. When the packer mandrel 52 is shifted relative to the shifting sleeve 98 during a retrieving operation, the snap ring 126 is shifted into the shifting slot 98 and away from the stop ring 96. The snap ring 126 is then blocked against retraction by a shoulder portion 98B of the shifting sleeve 98.

As a result of the packer and service tool combination, the load of the packer is borne by the transfer support lugs and not by the separation shear pins. Another important feature of this arrangement is that if it is necessary to push the packer against a binding force, the pushing forces are directed through the annular shoulder 52A of the packer mandrel and are applied through the service tool mandrel and through the packer mandrel, and not directed through shear pins. By this arrangement, pre-stretching and compression of the shear pins are avoided.

When it is necessary to transmit a deviated bore, or a tight bend of a horizontal completion, occasionally high amounts of torque are required to be transmitted through the packer and into the lower tail pipe section. Although the upper packer components are protected against premature set by the shear pins 82, premature set may be caused by rotation of the packer mandrel relative to the lower packer components under a combination of high torque and jarring loading which sometimes occurs during transit through tight bends. The transmission of torque is enhanced, according to the preferred embodiment of the present invention, by an anti-rotation lug 128 which projects radially through the lower wedge 124 and is fastened thereto by a threaded union T.

The anti-rotation lug 128 projects into an L-shaped slot 130 (FIG. 6A) which is machined into the packer mandrel body 52 and intersects its external surface. The head 128H of the anti-rotation lug projects radially into a longitudinal slot 108S which intersects the slip carrier 108. The L-slot 130 has a longitudinally extending slot portion 130L and a circumferentially extending slot portion 130C, as shown in FIG. 6A and FIG. 7. The short, circumferentially extending leg portion 130C of the slot 130 is wider than the longitudinally extending long leg portion 130L. The upper sidewall 130E of the short leg is inclined at a slight angle with respect to the bottom sidewall of the short leg to gradually increase the size of the slot in the clockwise direction away from the longitudinal leg portion 130L. Additionally, the intersection of the horizontal and vertical slots is smoothed by a chamfer 130F.

Referring to FIG. 6B, the slot 130 is a straight, longitudinally extending slot 130L, which does not include the circumferentially extending short leg slot portion. In the embodiment shown in FIG. 6B, the lug 128 and straight, longitudinal slot 130 limits rotation of the packer mandrel 52 relative to the tubular wedge 124 while permitting longitudinal movement of the packer mandrel relative to the tubular wedge.

Figure 6D:
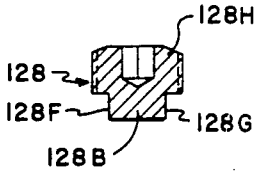
FIG. 6D is a sectional view of the anti-rotation lug shown in FIG. 6.
Figure 6E:
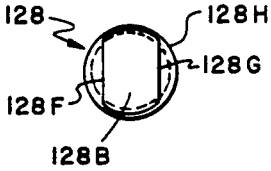
FIG. 6E is a bottom plan view thereof.

Referring now to FIG. 6, FIG. 6D and FIG. 6E, the body portion 128B of the lug 128 is milled to provide two opposing flats 128F, 128G. The diameter of the lug across the flats is approximately the same as the width of the slot 130. According to this arrangement, the opposed flats 128F, 128G are adapted for slidable movement along the parallel sidewalls 130A, 130B which provide parallel boundaries for the longitudinal slot 130L. With the flats 128F, 128G aligned with the slot, the lug 128 is prevented from rotating and unscrewing during operation. Since the circumferentially extending short slot portion 130C is slightly larger than the diameter of the lug, the lug 128 can be positioned within the short slot and unscrewed and removed for redressing or replacement.

During release of the packer, the shifting sleeve 98 is shifted relative to the shear sleeve 100. This produces separation of shear pins 101 which mechanically lock the shear sleeve 100 to the shifting sleeve 98 during run-in and set operations. As the shifting sleeve 98 is shifted relative to the shear sleeve 100, the setting cylinder 91 then engages the seal element mandrel 95 and displaces it upwardly thereby allowing the seal elements 36 to relax. Continued upward movement of the packer mandrel then brings the anchor slip carrier 108 into engagement with the upper wedge 102. In order for the packer to release effectively, the lower wedge must retract away from the lower spreader cone 116. Further upward pulling on the lower wedge will only cause the anchor slips to become embedded further. In installations where the lower wedge 124 is loaded by compression transmitted through the lower tubing string, it becomes very difficult to release the anchor slips. In such situations, it becomes necessary to transmit a jarring load onto the anchor slips in an attempt to produce retraction.

Figure 9:
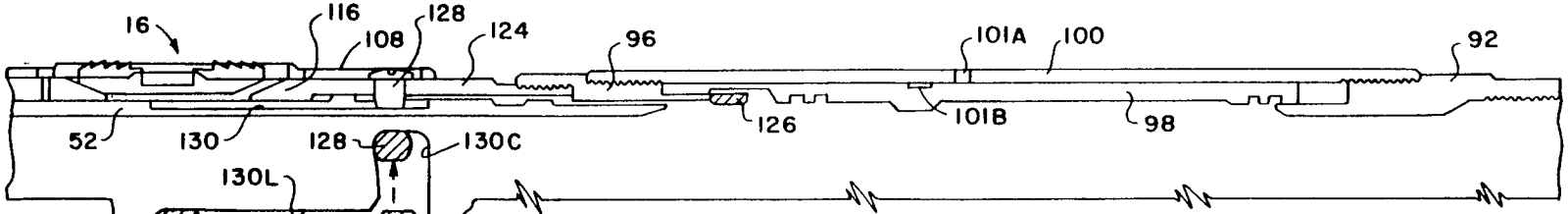
FIG. 9 is a view similar to FIG. 8 with the anti-rotation lug and packer components being shown in the post release position; and, FIG. 10 is a view similar to FIG. 9 with the anti-rotation lug and packer components being shown in the released position.
Figure 10:
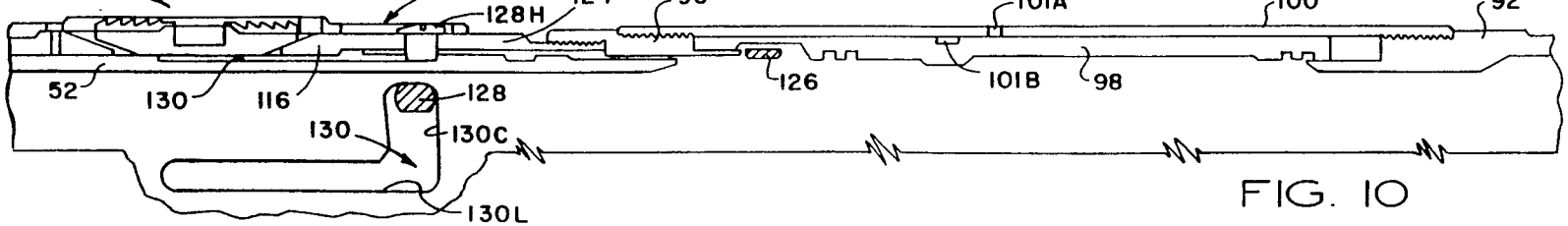

According to an important feature of the preferred embodiment, the circumferentially extending portion 130C of the L-slot 130 permits the anti-rotation lug 128 to be rotated out of the longitudinal slot portion 130L as shown in FIGS. 7, 8, 9 and 10. According to this arrangement, if a straight upward pull does not produce retraction of the anchor slips, the service tool and packer mandrel are rotated to the right, thereby drawing the anti-rotation pin 128 into the circumferentially extending slot portion 130C. With the anti-rotation pin 128 received within the circumferentially extending slot 130C (FIG. 9), it is then possible to transmit jarring loads through the service tool mandrel and packer mandrel. This causes the bottom cone 116 to be pulled away from the anchor slip 16 as shown in FIG. 9, thereby permitting the anchor slip to retract out of engagement with the well casing 20.

After the anchor slip 16 has retracted, as shown in FIG. 9, the anti-rotation pin 128 is still received within the circumferentially extending slot portion 130C. A straight pull upwardly on the service tool mandrel and packer mandrel draws the packer mandrel against the anti-rotation pin 128 as shown in the released position illustrated in FIG. 10. Continued upward motion of the packer mandrel then brings the upper wedge 102 into engagement with the slip carrier 95. Because the anti-rotation pin 128 is captured within the circumferentially extending slot portion 130C, it limits the longitudinal travel of the lower wedge 124, thereby preventing the lower spreader cone 116 from resetting the anchor slip 16. Longitudinal travel of the slip carrier 108 relative to the anti-rotation pin 128 is permitted by the slot 108S which is formed in the slip carrier 108 (FIG. 6B). While the longitudinal slot 108S formed in the slip carrier permits relative longitudinal movement of the slip carrier 108 relative to the lower wedge 124, the radially projecting head portion 128H provides a rotational lock between the slip carrier 10 and the lower wedge 124, thereby preventing rotation of the slip carrier relative to the lower wedge during running and setting operations.

It will be appreciated that the foregoing anti-rotation lug coupling assembly stabilizes the lower packer components against relative rotation during run-in. Since the anchor slip portion 16A, 16B are framed within windows formed within the slip carrier 108, the anti-rotation lug effectively provides a rotational lock of the anchor slips, slip carrier, lower wedge and packer mandrel. Accordingly, during running operations in which it is necessary to apply high torque and jarring forces, the lower packer components are stabilized against rotation relative to each other. That is, when the packer is run-in, the anti-rotation lug is positioned in the longitudinal extending portion 130L of the L-slot 130, and the head of the anti-rotation pin remains within the longitudinal slot 108S formed in the anchor slip carrier, thereby preventing relative rotation of the lower packer components, while permitting longitudinal displacement of the packer mandrel relative to the lower wedge 124 to accommodate setting and release operations. The anti-rotation lug is selectively releasable to permit rotation of the service tool relative to the packer mandrel during retrieving operations. This arrangement is particularly useful where the anchor slips are heavily embedded within the casing, for example, as a result of thermal expansion of the tubing below the packer which would cause the lower wedge to be compressed. In certain wells, the lower wedge and anchor slips may be subjected to corrosion and scaling, and may be bonded together so that retraction of the anchor slips cannot be effected by the coil spring. In those situations, the packer mandrel is rotated until the anti-rotation lug 128 is positioned within the pocket formed by the circumferentially extending slot portion of the L-shaped slot, so that pull up and set down jarring forces can be applied to the packer mandrel to push the lower wedge away from the anchor slip, thereby permitting the anchor slip to retract away from the set position.

It will also be appreciated that when the packer is run through a horizontal completion section, high torque forces may be required to be transmitted through the packer and into the lower tail pipe section in order to transit the tight bend upon approaching the horizontal section. By virtue of the anti rotation lug, it is possible to safely transmit the high torque loads which may be required to negotiate the tight bend. When the anti-rotation lug is positioned within the circumferentially extending pocket portion of the L-shaped slot, the service tool can be pulled up and set down repeatedly to cause the slips to ramp out of the casing. Consequently, the anti-rotation lug assembly of the present invention provides not only the capability of transmitting high torque loads, when desired, but also to move up and down in the well bore and work the slips free from the casing, if necessary.

Although the invention has been described with reference to a specific embodiment, and with reference to a specific gravel pack operation, the foregoing description is not intended to be construed in a limiting sense. Various modifications of the disclosed embodiments as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. A well packer comprising, in combination:

a tubular body mandrel having a longitudinal flow passage;

a seal element assembly mounted on said tubular body mandrel;

an anchor slip assembly mounted on said tubular body mandrel;

force transmitting apparatus movably coupled to said seal element assembly and said anchor slip assembly for extending said seal element assembly and said anchor slip assembly into set engagement against a well bore;

a tubular wedge coupled to said tubular body mandrel and engagable against said anchor slip assembly for limiting longitudinal travel of said anchor slip assembly and reacting setting forces transmitted thereto; and, apparatus coupling said packer mandrel to said tubular wedge for limiting rotation of said packer mandrel relative to said tubular wedge while permitting longitudinal movement of said packer mandrel relative to said tubular wedge; and said coupling apparatus comprising a slot intersecting said body mandrel through the external surface of said body mandrel and a lug mounted on said tubular wedge, said lug having a body portion projecting radially into said slot, and said slot having a longitudinally extending slot portion and a circumferentially extending slot portion.

2. A well packer comprising, in combination:

a tubular body mandrel having a longitudinal flow passage and a slot intersecting said body mandrel along the external surface thereof, said body mandrel slot having a longitudinally extending slot portion and a circumferentially extending slot portion;

a seal element assembly mounted on said tubular body material;

an anchor slip assembly mounted on said tubular body mandrel, said anchor slip assembly including a tubular slip carrier on which anchor slips are mounted for radial extension and retraction relative thereto, and said tubular slip carrier being intersected by a longitudinal slot;

force transmitting apparatus movably coupled to said seal element assembly and said anchor slip assembly for extending said seal element assembly and said anchor slip assembly into set engagement against a well bore;

a tubular wedge coupled to said tubular body mandrel and engagable against said anchor slip assembly for limiting longitudinal travel of said anchor slip assembly and reacting setting forces transmitted thereto;

apparatus coupling said packer mandrel to said tubular wedge for limiting rotation of said packer mandrel relative to said tubular wedge while permitting longitudinal movement of said packer mandrel relative to said tubular wedge; and said coupling apparatus including said body mandrel slot and a lug mounted on said tubular wedge, said lug having a body portion projecting radially into said body mandrel slot, and said lug having a head portion projecting radially into said slip carrier slot.

3. Well completion apparatus comprising, in combination:

a packer including a mandrel having anchor slips and seal elements carried on said packer mandrel for securing said packer in a well casing and sealing therebetween;

an annular piston mounted for longitudinal movement along said packer mandrel for extending said anchor slip and sealing elements into set engagement against said well casing;

a tubular bottom sub attached to and depending from the packer mandrel;

a tubular wedge secured to said bottom sub and disposed for engagement with said anchor slips for limiting longitudinal travel of said anchoring slips and for reacting setting forces transmitted through said anchoring slips;

apparatus coupling said packer mandrel to said tubular wedge for limiting rotation of said packer mandrel relative to said tubular wedge while permitting longitudinal movement of said packer mandrel relative to said tubular wedge, said coupling apparatus including a slot formed in said packer mandrel along the external surface thereof and a lug mounted on said tubular wedge, said lug having a body portion projecting radially into said mandrel slot; and, said packer mandrel slot having a longitudinally extending slot portion and a circumferentially extending slot portion.

4. Well completion apparatus as defined in claim 3, including a tubular slip carrier on which said anchor slips are mounted for radial extension and retraction relative thereto, and said tubular slip carrier being intersected by a longitudinal slot, said lug having a head portion projecting radially into said slip carrier slot.

5. In a subterranean well having a perforated casing embedded within a producing formation, a packer engaging said casing and having a mandrel supporting a screen adjacent the perforated zone of the casing, force transmitting means movably coupled on said packer mandrel for setting an anchor slip assembly against said casing, and a tubular wedge disposed for engagement with said anchor slip assembly for limiting longitudinal travel of said anchor slip assembly and for reacting setting forces applied to said anchor slip assembly, the improvement comprising:

apparatus coupling said packer mandrel to said tubular wedge for limiting rotational movement of said packer mandrel relative to said tubular wedge while permitting longitudinal movement of said packer mandrel relative to said tubular wedge, said coupling apparatus including a slot formed in the external surface of said packer mandrel, said slot having a longitudinally extending slot portion and a circumferentially extending slot portion; and, a lug mounted on said tubular wedge, said lug having a body portion projecting radially into said mandrel slot.

6. The packer improvement as defined in claim 5, said anchor slip assembly including a tubular slip carrier on which anchor slips are mounted for radial extension and retraction relative thereto, and said slip carrier being intersected by a longitudinal slot, said lug having a head portion projecting radially into said slip carrier slot.

7. A well packer comprising, in combination:

a tubular body mandrel having a longitudinal flow passage;

a seal element assembly mounted on said tubular body mandrel;

an anchor slip assembly mounted on said tubular body mandrel;

force transmitting apparatus movably coupled to said seal element assembly and said anchor slip assembly for extending said seal element assembly into set engagement against a well bore;

a tubular wedge coupled to said tubular body mandrel and engagable against said anchor slip assembly for limiting longitudinal travel of said anchor slip assembly and reacting setting forces transmitted thereto;

apparatus coupling said packer mandrel to said tubular wedge for limiting rotation of said packer mandrel relative to said tubular wedge while permitting longitudinal movement of said packer mandrel relative to said tubular wedge, said coupling apparatus comprising a slot formed in the external surface of said body mandrel and a lug mounted on said tubular wedge, said lug having a body portion projecting radially into said slot; and, said slot having a longitudinally extending slot portion and a circumferentially extending slot portion.

8. A well packer as defined in claim 7, said anchor slip assembly including a tubular slip carrier on which anchor slips are mounted for radial extension and retraction relative thereto, and said tubular slip carrier being intersected by a longitudinal slot, said lug having a body portion projecting radially into said packer mandrel slot, and said lug having a head portion projecting radially into said slip carrier slot.

9. Well completion apparatus comprising, in combination:

a packer including a mandrel having anchoring means and seal elements carried on said packer mandrel for securing said packer in a well casing and sealing therebetween;

an annular piston mounted for longitudinal movement along said packer mandrel for extending said anchor slip and sealing elements into set engagement against said well casing;

a tubular bottom sub attached to and depending from the packer mandrel;

a tubular wedge secured to said bottom sub and disposed for engagement with said anchor slips for limiting longitudinal travel of said anchoring slips and for reacting setting forces transmitted through said anchoring slips; and, apparatus coupling said packer mandrel to said tubular wedge for limiting rotation of said packer mandrel relative to said tubular wedge while permitting longitudinal movement of said packer mandrel relative to said tubular wedge.

10. Well completion apparatus as defined in claim 9 said coupling apparatus comprising a slot formed through the external surface of said packer mandrel and a lug mounted on said tubular wedge, said lug having a body portion projecting radially into said slot.

11. Well completion apparatus as defined in claim 10, said slot having a longitudinally extending slot portion and a circumferentially extending slot portion.

12. Well completion apparatus as defined in claim 9, said anchoring means including a tubular slip carrier on which anchor slips are mounted for radial extension and retraction relative thereto, and said tubular slip carrier being intersected by a longitudinal slot, said coupling apparatus including a slot formed in the external surface of said packer mandrel and a lug mounted on said tubular wedge, said lug having a body portion projecting radially into said slot, and said lug having a head portion projecting radially into said slip carrier slot.

13. In a subterranean well having a perforated casing embedded within a producing formation, a packer engaging said casing and having a mandrel supporting a screen adjacent the perforated zone of the casing, force transmitting means movably coupled on said packer mandrel for setting an anchor slip assembly against said casing, and a tubular wedge disposed for engagement with said anchor slip assembly for limiting longitudinal travel of said anchor slip assembly and for reacting setting forces applied to said anchor slip assembly, the improvement comprising:

apparatus coupling said packer mandrel to said tubular wedge for limiting rotational movement of said packer mandrel relative to said tubular wedge while permitting longitudinal movement of said packer mandrel relative to said tubular wedge, said coupling apparatus including an L-slot intersecting the external surface of said packer mandrel, said L-slot having a longitudinally extending slot portion and a circumferentially extending slot portion; and, a lug mounted on said tubular wedge, said lug having a body portion projecting radially into said slot.

14. The packer improvement as defined in claim 13, said anchor slip assembly including a tubular slip carrier on which anchor slips are mounted for radial extension and retraction relative thereto, and said slip carrier being intersected by a longitudinal slot, said lug having a head portion projecting radially into said slip carrier slot.

15. A hydraulic well packer comprising, in combination:

a tubular mandrel having a longitudinal flow passage;

a seal element assembly movably mounted on said packer mandrel;

an anchor slip assembly movably mounted on said packer mandrel;

hydraulic actuating means mounted onto said packer mandrel including an annular piston disposed in slidable, sealing engagement on said packer mandrel;

force transmitting apparatus coupled to said annular piston, said seal element assembly and said anchor slip assembly for extending said seal element assembly and said anchor slip assembly into set engagement against a well bore in response to the application of hydraulic pressure against said annular piston;

a tubular wedge coupled to said packer mandrel, said tubular wedge being engagable with said anchor slip assembly for limiting longitudinal movement of said anchor slip assembly relative to said packer mandrel and for reacting setting forces applied thereto; and, apparatus coupling said packer mandrel to said tubular wedge for limiting rotational movement of said packer mandrel relative to said tubular wedge while permitting longitudinal movement of said packer mandrel relative to said tubular wedge during a first operating mode, and for permitting rotational movement of said packer mandrel relative to said tubular wedge while limiting longitudinal movement of said packer mandrel relative to said tubular wedge during a second operating mode.

16. A hydraulic well packer as defined in claim 15, said coupling apparatus comprising an L-slot intersecting the external surface of said packer mandrel and a lug mounted on said tubular wedge, said lug projecting radially into said L-slot.

17. A hydraulic well packer as defined in claim 15, said anchor slip assembly including a tubular slip carrier on which anchor slips are mounted for radial extension and retraction relative thereto, and said tubular slip carrier being intersected by a longitudinal slot, said coupling apparatus including an L-slot intersecting the external surface of said packer mandrel and a lug mounted on said tubular wedge, said lug having a body portion projecting radially into said L-slot, and said lug having a head portion projecting radially into said slip carrier slot.

* * * * *